US006325116B1

(12) United States Patent
Savage et al.

(10) Patent No.: US 6,325,116 B1
(45) Date of Patent: Dec. 4, 2001

(54) ADAPTER FOR PROVIDING FLUID CONTROL BETWEEN A CANTEEN AND A FACE MASK FLUID TUBE

(75) Inventors: John Savage; Kimberley Bucci, both of Gloucester (CA)

(73) Assignee: DEW Engineering and Development Limited, Ottawa (CA)

( * ) Notice: Subject to any disclaimer, the term of this patent is extended or adjusted under 35 U.S.C. 154(b) by 0 days.

(21) Appl. No.: 09/583,239

(22) Filed: May 31, 2000

(30) Foreign Application Priority Data

Oct. 7, 1999 (CA) ..... 2285491

(51) Int. Cl.[7] ..... B65B 3/00; B67C 3/00

(52) U.S. Cl. ..... 141/349; 141/348; 141/383; 128/206.22

(58) Field of Search ..... 141/348, 349, 141/351–354, 372, 379, 382, 383; 128/206.22; 251/149.6, 149.7

(56) References Cited

U.S. PATENT DOCUMENTS 3,731,717 * 5/1973 Potash ..... 141/349

* cited by examiner

*Primary Examiner*—Timothy L. Maust
(74) *Attorney, Agent, or Firm*—Freedman & Associates

(57) ABSTRACT

A canteen especially useful in extreme environments includes a hollow watertight container adapted to hold a quantity of a drinking fluid. An adapter allows the canteen to be sealed with a gas mask adapter depending from the face mask, in such a manner as to allow the passage of fluid between the canteen and a delivery tube within the mask accessible by a user with minimal or no contamination of the contents of the canteen in an identified nuclear, biological, or chemical threat. In a first position, the adapter allows fluid flow between delivery tube and the canteen, and in a second stopped position, fluid is prevented from leaving the canteen.

18 Claims, 3 Drawing Sheets

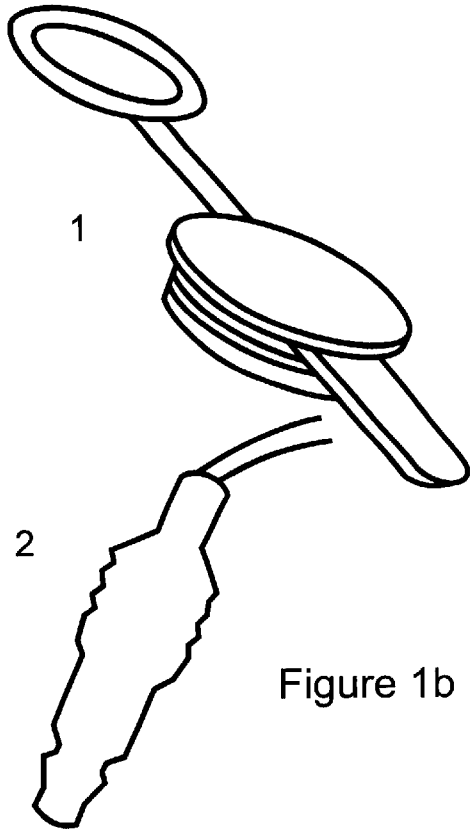
Figure 1a
Figure 1b
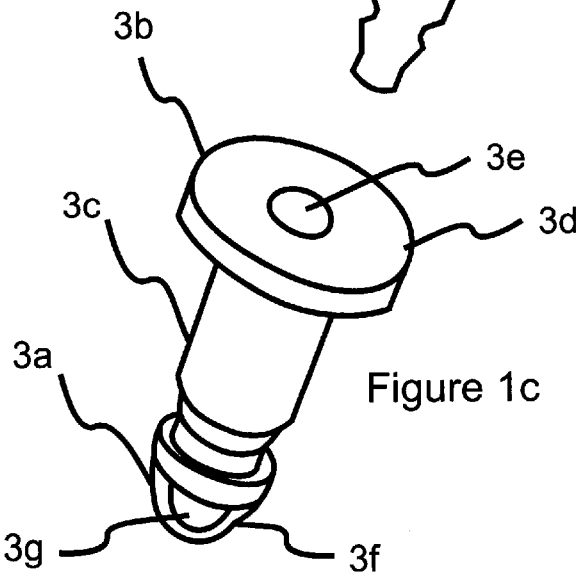
Figure 1c
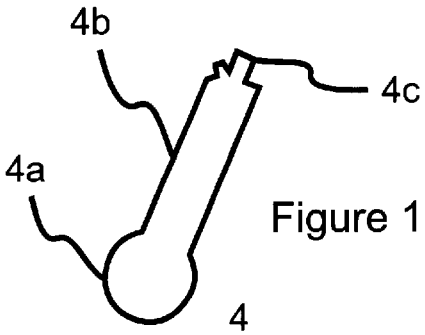
Figure 1d
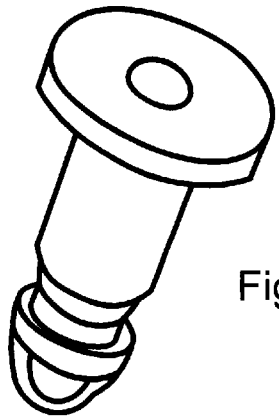
Figure 1e

ADAPTER FOR PROVIDING FLUID CONTROL BETWEEN A CANTEEN AND A FACE MASK FLUID TUBE

FIELD OF THE INVENTION

The present invention relates to an adapter that allows a fluid to be extracted from a canteen with little or no substantial contamination of the contents of the canteen in an identified nuclear, biological or chemical threat.

BACKGROUND OF THE INVENTION

In a chemically hazardous environment, it is often necessary for an individual wearing a protective mask e.g. a face mask or a gas mask, to drink from a canteen or other closed liquid storage container without necessitating removal of the protective mask or contamination of the liquid. In the past, there have been many different devices designed for the transfer of fluids from a closed vessel, such as a canteen, to an individual wearing a protective mask.

In U.S. Pat. No. 4,090,650 a canteen is provided with a drinking straw extending through the top of the screw cap of the canteen. The straw may be pushed substantially completely into the canteen when the straw is not used or it may be withdrawn from the canteen to a substantial length such that one may drink from the canteen without removing it, for example, from a belt. The screw cap and canteen neck are provided with cooperating elements which pinch the straw closed in the closed position of the cap. This fluid transfer design does not prevent contamination of the liquid or individual, when the individual drinks from the canteen in a contaminated environment.

In U.S. Pat. No. 3,731,717 there is disclosed a canteen for use with a gas mask that permits drinking and resuscitation while wearing the mask in a contaminated atmosphere. Communication between the interior of the mask and the interior of the canteen is established by means of a single tube, which is connected to the mask on one side, and to a connection member for connecting to a drinking or resuscitation connection member, on the other side. To enable drinking without removing the mask from the wearer's face, the canteen is provided with a cap having a quick disconnect coupling. Although this patent discloses a useful working embodiment, it is complicated and requires specialized components for dispensing fluid without contamination of the fluid. This device has a number of inherent disadvantages. Primarily, the disadvantages are related to the excessive number of parts, which increases the susceptibility of the system to damage. For example, each of the many components within the system is subject to varying degrees of material fatigue or failure, and consequently the system has a multitude of 'weak spots' inherent in the construction. The spring, which is essential to the device, is a particularly defective component. Furthermore, the device is mounted to the outside of the canteen, thus increasing the probability of damage in the event the canteen is dropped or bumped. Many of the components within the device are constructed from metal, which can deform when exposed to extensive stress, and which is frequently subject to corrosion i.e., rust. Moreover, the manufacturing cost of this device is high, primarily due to the time consuming assembly, but also due to the intricacy of the specialized parts.

U.S. Pat. No. 4,971,048 discloses a liquid transfer device comprising a pair of parallel fluid flow paths, within a single tube, which respectively include oppositely directed check valves. The parallel flow paths merge at the opposite ends of the tube assembly to form common flow paths. One or both of the common flow path defining ends of the tube assembly can be equipped with quick disconnect type fittings which cooperate with complementary fittings on the storage container and/or the protective mask. The advantages of this liquid transfer device include being able to drink from the canteen without raising the canteen to the level of the mask, and the fact that no vacuum is created in the canteen when the wearer is drinking. The disadvantages are similar to the disadvantages of the single tube fluid transfer device discussed above, but also include the disadvantages associated with the complexity of additional check valves within the parallel fluid flow paths.

In U.S. Pat. No. 4,823,785 there is disclosed a device associated with a gas mask suitable for introducing liquid substances to the user of the mask. The liquid substances are contained in a container provided with a penetrating or syringe-shaped nozzle. The device comprises a tubular conduit inside the mask having at least one elbow portion elastically deformable from a first idle position to a second position at or adjacent to the user's mouth and vice versa, respectively, when the penetrating nozzle is introduced inside the conduit through the entire elbow position and withdrawn from the same elbow portion. This device is intended to replace conventional couplings, and hence is not for use with commercially available canteens and gas masks.

U.S. Pat. No. 4,712,594 discloses a liquid storage and delivery system for use with protective masks having hand-operable bulb siphon pumps in line with conduits extending from a canteen assembly to the drinking mouthpiece of the protective mask. The system includes structure to allow a user to drink directly from a central storage/dispensing reservoir by connecting the conduits directly thereto, and also allows the canteen assembly to be refilled from the reservoir while maintaining the system's protective integrity. The bulb-type siphon pump is formed of a rubber or rubber-like material, which is susceptible to material fatigue or failure. The extensive amount of tubing increases the risk of accidental disengagement. Overall, the design and multitude of components are quite complicated.

Other protective masks designed to meet emergency situations include the purification or filtration of the drinking water. These designs are useful when the liquid itself is suspected of containing contaminating material, but in general are very complicated, and are not well suited for economical mass use.

In U.S. Pat. No. 4,714,550 there is disclosed a water purifying system which includes an elongate chambered purifying assembly sized to be detachably mounted in a conventional canteen. The assembly is provided with an internal chamber filled with a particulate water purifying material and concentric tubes within the chamber require water flowing into the chamber through a filtered inlet at the bottom of the assembly to flow an extended chambered flow path through the purifying material to an outlet at the top of the assembly. The assembly includes a manually operable pump for pressurizing said container, thereby pumping water from the canteen through the purifying assembly.

In U.S. Pat. No. 5,167,819 there is disclosed a canteen especially useful in contaminated environments, which includes a hollow watertight container adapted to hold a quantity of a drinking fluid and a filter device extending into the container through an opening at the top. The filter device comprises an elongated tubular member having disposed therein an air filter for filtering the air entering the container and a water filter for filtering the drinking fluid exiting the container. In using the canteen, air is drawn into the container though the air filter and drinking fluid is drawn out from the container through the water filter by suction.

Accordingly, the need exists for a fluid delivery system that is simple in design, economical to manufacture, readily adaptable to protective equipment already in widespread use, and is manufactured in a manner and with materials which allow the integrity of the fluid delivery system to be maintained, in all inclement, chemically hostile, or combat environments.

It is an object of this invention to provide an adapter suited to couple a commercially available canteen with a commercially available gas mask that is less complicated than the prior art embodiments, and which is constructed so that liquid can be extracted therefrom while exposed to a nuclear, biological or chemical threat without forcing the user to be exposed.

It is another object 6f this invention to provide a fluid transfer device that is constructed from materials that are robust, resist corrosion, are readily available, and which enables an individual wearing a protective mask to drink from a canteen without necessitating removal of the protective mask, or worrying about the integrity of the device.

It is another object of this invention to provide a two piece adapter that is simple in design and economical to manufacture, and which allows the transfer of fluid from a canteen to a fluid delivery tube within a gas mask, for use in a potentially contaminated environment.

It is yet another object of this invention to provide a fluid transfer device, which is easy to use and allows for convenient coupling between a fluid containing device and an individual wearing a protective mask.

It is still another object of this invention to provide a canteen, which can be used with a gas mask while the gas mask is being worn.

SUMMARY OF THE INVENTION

In accordance with the invention, there is provided an adapter for use in a fluid delivery system, said system of the type including a protective mask having a fluid delivery tube on the interior thereof, a gas mask adapter depending from an outside region of the protective mask and coupled to the fluid delivery tube, and a canteen for the storage of a drinking fluid, said adapter comprising:

a one-piece sleeve having an opening for allowing fluid to pass therethrough, an upper sealing portion for sealing the adapter within the neck of the canteen, and a lower deformable portion; and a stopper disposed within at least a portion of the opening, movable to at least two different positions within the opening, a first position corresponding to a sealed mode of operation preventing the drinking fluid from leaving the canteen, and a second position corresponding to an open mode of operation allowing the drinking fluid to pass through the one-piece sleeve; wherein the lower deformable portion is normally biased to secure the stopper in the first position corresponding to a sealed mode of operation, and deformable to accommodate the stopper in the second position corresponding to an open mode of operation.

In accordance with another embodiment of the invention, there is provided an adapter for use in a fluid delivery system, said system of the type including a protective mask having a fluid delivery tube on the interior thereof, a gas mask adapter depending from an outside region of the protective mask and coupled to the fluid delivery tube, and a canteen for the storage of a drinking fluid, said adapter consisting of:

a one-piece sleeve having an opening for allowing fluid to pass therethrough, an upper sealing portion for sealing the adapter within the neck of the canteen, and a lower deformable portion; and a stopper disposed within at least a portion of the opening within the sleeve, and movable to at least two different positions within the sleeve, a first position corresponding to a sealed mode of operation preventing the drinking fluid from leaving the canteen, and a second position corresponding to an open mode of operation allowing the drinking fluid to pass through the one-piece sleeve; wherein the lower deformable portion is normally biased to secure the stopper in the first position corresponding to a sealed mode of operation, and deformable to accommodate the stopper in the second position corresponding to an open mode of operation.

In accordance with another embodiment of the invention, in a fluid delivery system for use with a canteen which enables an individual wearing a protective mask to drink a fluid contained within the canteen without necessitating removal of the protective mask, an adapter disposed within the neck of the canteen, for coupling the canteen to a fluid delivery tube contained within the protective mask, via a gas mask adapter depending from the protective mask and coupled to the fluid delivery tube, said adapter comprising:

a stopper for preventing the flow of the fluid from inside the canteen to outside the canteen in a first mode of operation, and allowing the fluid to pass from inside the canteen to outside the canteen in a second mode of operation; and a sleeve for disposing the stopper therein, said sleeve including sealing means for sealing within the neck of the canteen, an opening for communicating between the interior of the canteen and the exterior of the canteen, and deformable biasing means for normally biasing the stopper in a first position corresponding to the first mode of operation, and for deforming to accommodate the stopper in a second position corresponding to the second mode of operation when an external force is applied thereto, said deformable biasing means in contact with the fluid contained within the canteen.

In accordance with another embodiment of the invention, there is provided, a fluid delivery system for dispensing fluids from a canteen to a gas mask having a gas mask adapter, comprising:

an adapter for coupling with an upper neck region of the canteen, the adapter having a single movable member therein, disposed within a portion of an opening thereof, the single movable member movable to a first position blocking the opening of the sleeve and to a second position unblocking the opening of the sleeve, the single movable member in use actuated by the gas mask adapter, and the gas mask adapter in use actuated by the single moveable member.

In accordance with another embodiment of the invention, there is provided, an adapter system for providing passage of a fluid in a canteen body to a fluid delivery tube within a face mask, the adapter system providing means of connecting the fluid delivery tube with the canteen body to deliver fluid in a first mode of operation, and for preventing the delivery of fluid to the fluid delivery tube in a second mode of operation, the adapter comprising:

a sleeve sealing about the neck of the canteen, the sleeve having an opening for allowing fluid to pass therethrough; and, a plug disposed within the sleeve biased to normally block the opening and prevent fluid to pass through the opening.

In accordance with another embodiment of the invention, in a fluid delivery system having a canteen for storing and dispensing fluid and having a gas mask with a fluid delivery tube within and a tubular coupling attached thereto for carrying fluid between the canteen and the fluid delivery tube, an adapter for sealing with the tubular coupling and the canteen, to prevent contamination of a fluid within the canteen, the adapter having stopper means disposed within, for preventing the flow of fluid from the canteen to the fluid delivery tube in a first mode of operation, and the stopper means allowing fluid to pass from the canteen to the fluid delivery tube in a second mode of operation.

In accordance with an aspect of the invention, an adapter comprising a deformable tubular insert for inserting into a canteen, the deformable insert having a longitudinal bore extending between openings on either end, and having an elastically banded region at an end for accommodating a head of a stopper, the head of the stopper being larger than the opening at the end about the elastically banded region.

BRIEF DESCRIPTION OF THE DRAWINGS

Exemplary embodiments of the invention will now be described in conjunction with the drawings in which:

FIGS. 1*a* through 1*e* illustrate the components of the adapter in accordance with the invention;

DETAILED DESCRIPTION

Figure 2A:
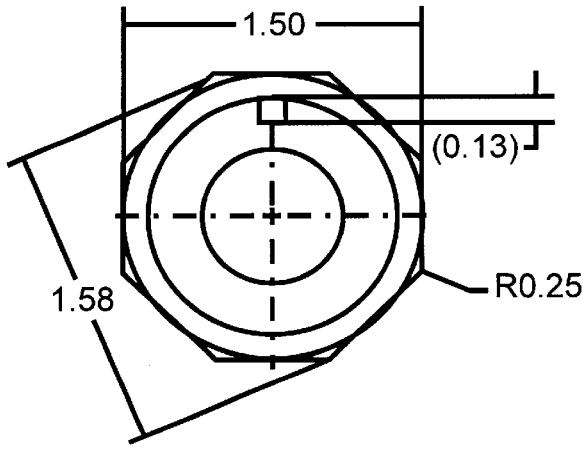
FIGS. 2*a* through 2*c* illustrate three views of a plastic holder or receptacle for accommodating the adapter in accordance with the invention; and, FIG. 3 illustrates the adapter in accordance with an embodiment of the invention.

Referring to FIG. 1*c*, an adapter in the form of a sleeve 3 having a substantially D-shaped pen lower end 3*a* and a sealing upper end 3*b*, connected together through a cylindrical middle section 3*c*, is shown. The sleeve is made of an elastomeric material, such as silicon or a deformable rubber. The sealing upper end 3*b* has a wide flange seal 3*d*, and an opening 3*e* which extends through the sleeve 3 to communicate with the substantially D-shaped opening 3*f*. In this unblocked position, fluid can flow through the sleeve 3 without being restricted. The openings in the upper sealing end 3*e* and the cylindrical middle section 3*c*, having comparable interior diameters, are separated by an interior wall 3*h* having a central opening 3*i* with a substantially smaller diameter.

In FIG. 1*d*, a valve or stopper 4 having a ball-shaped lower end 4*a*, connected to a rodshaped upper end 4*b* having a substantially x-shaped cross section, is shown. The magnitude of the substantially x-shaped cross section is substantially equal to the interior diameter of the cylindrical middle section of the sleeve 3*c*. The diameter of the ballshaped lower end 4*a* is larger than the magnitude of the substantially x-shaped cross section. When the rod-shaped upper end 4*b* is inserted into the cylindrical middle section 3*c* through the D-shaped opening 3*f*, four longitudinal channels are formed by the chambers defined by the four arms of the 'x' of the x-shaped cross section and the interior walls of the cylindrical middle section 3*c*. The ball-shaped lower end 4*a* does pass into the cylindrical middle section 3*c* of the sleeve. A small cylindrical abutment 4*c* projects from the rod-shaped upper end, in a direction opposite to the ball-shaped lower end 4*a*, and rests within a central opening 3*i* when the rod-shaped upper end 4*b* is inserted into the cylindrical middle section 3*c* through the D-shaped opening 3*f*. The stopper is made of an appropriate plastic.

FIG. 1*e* illustrates the stopper 4 inserted into the sleeve 3. When the rod-shaped upper end 4*b* fully extends into the cylindrical middle section 3*c* of the sleeve, the ball-shaped lower end 4*a* of the stopper fits snugly in the D-shaped opening 3*f* of the sleeve. The stopper is held in place by the lower band 3*g* defining the D-shaped opening 3*f* of the sleeve. The elliptical bottom is contoured to reliably secure the ball-shaped lower end therein. The round shape of the ball-shaped lower end permits a tight seal between the stopper and the D-shaped opening within the sleeve, for preventing fluid from passing through the sleeve, and advantageously, allows a degree of angular movement of the stopper within the sleeve, while still maintaining an effective seal. The effective seal is largely due to the large amount of accessible surface area of the ball-shaped lower end, which can engage any portion of the elliptical bottom or the lower opening. In the absence of any externally applied forces, the shape and resilient nature of the sleeve 3 biases the stopper towards the upper section 3*b* of the sleeve, thereby securing the seal between the ball-shaped lower end 4*a* of the stopper and the straight edge of the D-shaped opening 3*f* of the sleeve. In this blocked position, fluid or more specifically liquid is prevented from passing through the sleeve 3.

When an external force is applied to the stopper 4 in a direction parallel to the longitudinal axis of the stopper, such that the ball-shaped lower end 4*a* pushes against the lower band 3*g*, the stopper can be dislodged from the blocked position. If the applied force is great enough, the stopper is displaced to an extent that the ball-shaped lower end 3*a* no longer seals the lower opening 3*f* of the sleeve 3, and fluid is permitted to pass through the channels defined by the x-shaped cross section of the rod-shaped upper section 4*b* of the stopper, and the cylindrical middle section 3*c* of the sleeve 3. When the applied force originates from a tube or hollow sleeve inserted into the opening 3*e*, the adapter provides means for communicating between the region outside the ball-shaped lower end 4*a* and the interior of the tube or hollow sleeve.

Accordingly, this simple assembly of two elements, the sleeve 3 and the stopper 4, provides sealing in one mode of operation, preventing fluid from flowing, and allows fluid transfer in another mode of operation.

Figure 2B:
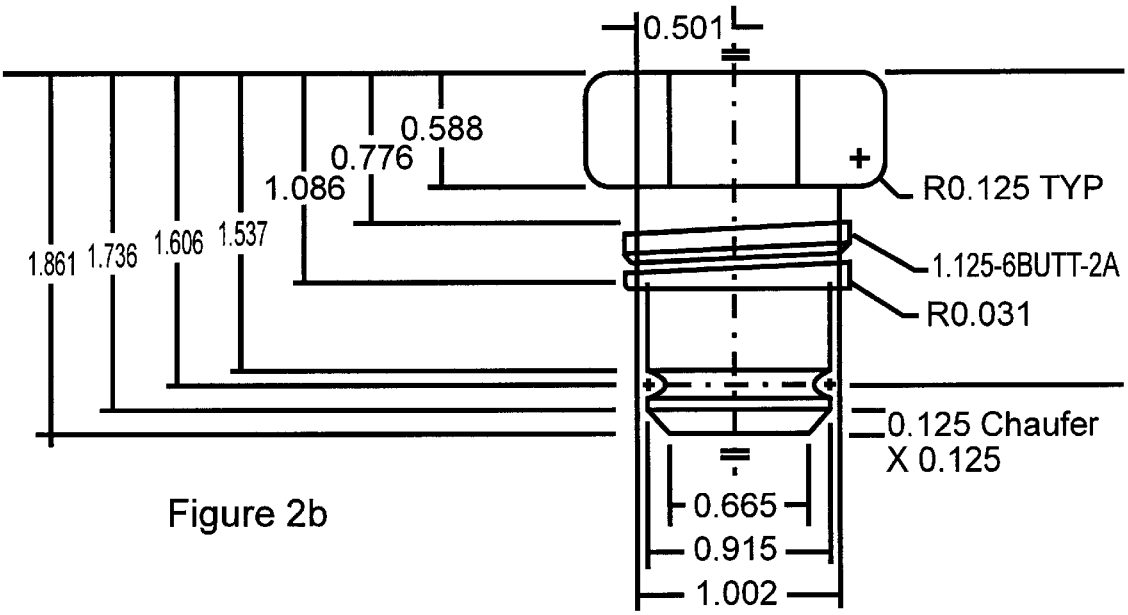
Figure 2C:
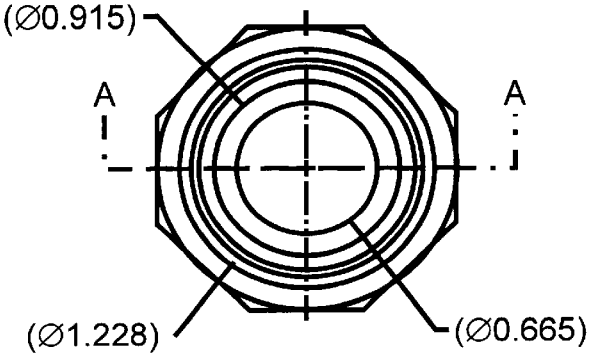

In use, this assembly shown in FIG. 1*e* is inserted into a typical canteen, and is secured within the neck portion, the D-shaped opening disposed downward into the canteen body. FIGS. 2*a* through 2*c* illustrate a plastic holder or cup 5 used to secure the sleeve 3 to the neck of the canteen. The holder 5 screws into the canteen top about the neck and holds the sleeve 3 in place. With the bolder 5 secured within the canteen and the adapter assembly secured in the sealed mode of operation, contaminants outside the canteen are prevented from passing into the canteen.

To assemble the adapter, the sleeve 3 is pushed into the holder 5 and the stopper 4 is inserted into the sleeve 3 by pushing aside the elliptical bottom i.e. the D-shaped band 3*g*, and sliding the stopper 4 up until the elliptical bottom returns to it's rest position.

FIG. 1*a* shows a dust cover or cap 1 that normally covers the sleeve 3 and the stopper 4 contained within the holder 5, when the canteen is not in use. The cap 1 provides additional protection from the external environment, and easily snaps on and off. In general, the cap 1 has the same composition as the sleeve 3, e.g. silicone. The cap 1 is removed when the canteen is to be coupled with a face mask.

Preferably, the composition of the cap 1 and sleeve 3 accommodates de-contamination. For example, silicone and butyl rubber are particularly resistant to commonly used decontamination fluids. Silicone is particularly pliable and workable, and more importantly, has favourable 'food grade' characteristics.

FIG. 2*a* illustrates a gas mask adapter (GMA) 2, which is typically provided on readily available gas masks. The GMA 2 depends from an outside region of the gas mask and is generally contained within a container on the mask. On the inside of the mask, a tube for drinking e.g. a fluid delivery tube or drinking tube, is coupled with the GMA 2.

Conveniently, the GMA 2 fits snugly into the upper opening 3*e* of the sleeve 3. When the GMA 2 is forcibly inserted into the upper opening 3*e* of the sleeve, it engages the interior wall 3*h* separating the cylindrical middle section 3*c* and the upper opening 3*e* of the sleeve 3. With the pressure applied through the interior wall 3*h*, the GMA 2 drives the stopper 4 downwards against the lower band 3*g*, which deforms to accommodate the advancing stopper 4, thereby unblocking the assembly. As the GMA 2 pushes against the interior wall 3*h* separating the cylindrical middle section 3*c* and the upper opening 3*e*, the small cylindrical abutment 4*c* projecting from the rod-shaped upper end 4*b* of the stopper is forced through the central opening 3*i*, enters the upper opening 3*e*, and passes into the lower opening 2*a* of the GMA, where it engages and opens the valve within the GMA 2. Thus, allowing fluid to pass from inside the canteen, through the adapter, to the GMA.

In practice a canteen, filled with drinkable fluid, is equipped with the disclosed assembly. Prior to the insertion of the GMA 2 into the sleeve opening 3*e*, the stopper is biased to normally maintain closure around the lower opening 3*f*, thereby ensuring that the contents of the canteen are not contaminated by the contaminants outside the canteen.

The cap 1 provides additional protection from the external environment. This is the resting state of the assembly and can be described as a sealed or closed mode of operation, wherein no fluid is permitted to escape from the interior of the canteen. To initiate drinking, the cap 1 is removed from atop the adapter and the GMA is inserted into the opening 3*e* of the sleeve. When the GMA 2 is pushed far enough into the opening of the sleeve 3*e*, it depresses the stopper 4 and locks in place, as described above. This pressure forces the stopper against the lower band 3*g* of the sleeve 3, thus advancing the ball-shaped lower end 4*a* further into the deforming lower band 3*g*, and away from the straight edge of the D-shaped opening 3*f*, thus unlocking the seal and opening a passage for the liquid to pass straight through the insert and the GMA, until it enters the fluid delivery tube and into the mouth of the gas mask wearer, when the canteen is tilted upward so that gravity forces the contents of the canteen to pass into the mask via the GMA 2. This is the active state of the assembly and can be described as an open or flowing mode of operation. In this state, fluid flows between the canteen and the fluid delivery or drinking tube. For example, the user blows air into the drinking tube as the liquid contained within the canteen is removed, thus enabling the user to drink under slight pressure conditions rather than vacuum. Contaminants are prevented from entering into the system due to the fluid tight connections between the canteen and the GMA i.e. the adapter.

Figure 3:
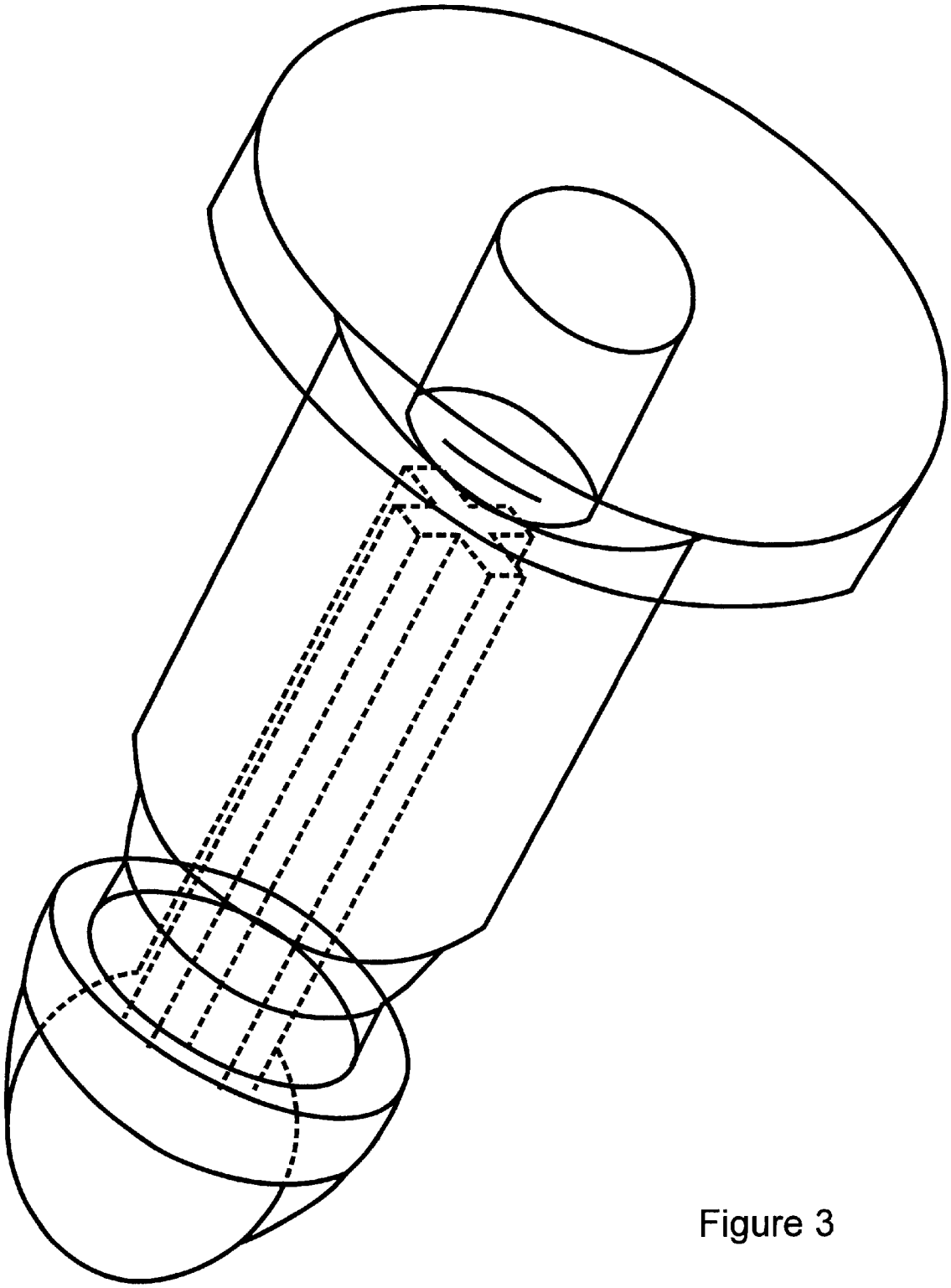

To terminate drinking, the canteen is returned to a non-elevated position, shifting the remaining liquid in the assembly to the canteen, and the coupling between the adapter and the GMA is removed by disengaging the GMA from the adapter. As the GMA is disengaged from the adapter, the stopper is immediately biased to return to the sealed mode of operation, due to the elastic nature of the sleeve, thus sealing the remaining, non-contaminated fluid within the canteen. Of course, if the canteen is empty another canteen equipped with an adapter 3 sealed by a cap 1 and stopper 4 can be placed on the mask for use. FIG. 3 illustrates the adapter in accordance with an embodiment of the invention.

In an embodiment of the invention, a multitude of canteens are equipped with the adapter assembly to provide a multitude of face mask wearers with access to drinking water, or the like, when in a contaminated environment. The adapter assembly permits a quick coupling i.e., connection or separation, of the canteen and the face mask. The multitude of canteens equipped with the adapter provides the face mask wearers with a constant supply of fluid, and alleviates the need to refill the canteen while in the contaminated environment.

In another embodiment, the GMA is secured to the gas mask, and the canteen is connected to the GMA when the individual chooses to drink. The adapter provides the standard function of a plug i.e., keeps fluids in, and also acts as a valve. No extra parts are needed. Advantageously, the valve is actuated when a gas mask adapter is inserted in the upper opening of the sleeve, and simultaneously actuates a valve within the gas mask adapter, thus allowing fluid to flow therebetween.

In the preferred embodiment the adapter is secured within the neck of the canteen. As a result, the device is constantly protected while in use and during transit, and the face mask wearer can be assured of the integrity of the device, and consequently of the safety of the drinking fluid. Since the device is positioned within the neck of the canteen, it is less likely to come loose or get lost. Furthermore, since the stopper includes an advantageously ball-shaped lower portion, the adapter can undergo angular displacement without compromising the integrity of the fluid delivery system.

The adapter allows the protected operator to access fluids during an identified nuclear, biological or chemical threat, without exposing the operator to the threat. Preferably, the drinking of fluids takes place before or after exposure to the nuclear, biological, or chemical agents.

Since the preferred adapter has only two parts, the sleeve and the stopper, wherein the sleeve houses the stopper and acts as a means for biasing the stopper in a closed position and for deforming to accommodate the stopper in an open position, there is no need for additional spring or holding means which can be easily broken or damaged, thereby risking contamination of the drinking fluid contained within the canteen.

The cost of this simple and effective system is relatively low, due to few required components, and due to the fact that these components can be easily manufactured with readily available materials.

In the preferred embodiment, the invention is used with currently available canteens, and currently available gas masks. What is provided is an adapter with one moving part, which is highly robust and enduring.

In the instant invention the resilient sleeve acts as both a sealing member and a biasing member, reducing the number of parts and reducing the cost of manufacturing. Metallic springs are not desired due to the complexity, cost of manufacture, and tendency to corrode. Moreover, metallic parts are good thermal conductors. The sleeve according to the present invention is a poor thermal conductor.

Since the sleeve is constructed from a strong, resilient and deformable material, this invention is particularly well suited for use in unfriendly climates. For example, in the north where extreme cold can render currently available drinking assemblies stiff, awkward, and subject to breakage, the instant invention is well adapted. Alternatively, in the desert where sand and wind can interfere with the complex mechanism of other fluid transfer devices, the instant device functions well.

Advantageously, the assembly is easily taken apart for cleaning and decontamination.

Of course, numerous other embodiments can be envisaged, without departing from the scope of the invention. For example, additional sealing means can be provided within the sleeve and/or the GMA for use in extremely toxic environments. Specifically, the additional sealing means within the GMA can take the form of a cover within the cylindrical opening 2*a* of the GMA, that when intact prevents contaminants from entering into the system, and that can be pierced by the upper end of the stopper 4*c* in the active state of the assembly to open a passageway from the inside of the canteen to the GMA. Similarly, the upper end of the sleeve 3 can be covered with a similar material that can be pierced or broken by the GMA. Appropriate care must be taken to ensure these coverings do not impede fluid flow to a great extent after being pierced. After the object piercing the cover is removed from the cover, the additional sealing means can return to the original sealed state i.e., are resealable and thus reusable, or can preserve the ruptured state, thus serving as an indication that the contents of the canteen may not be pure.

In a further embodiment, the opening 3*e* within the sleeve is constructed with a partition that prevents fluids from entering into the adapter i.e., the wall 3*h* spans the entire diameter of the middle cylindrical section 3*b*, maintaining the assembly in a continuously closed state. Fluid flow is initiated when the upper end of the stopper, appropriately constructed to allow fluid flow therethrough, pierces the partition. In this embodiment the partition is resealable. Of course, the GMA may also be equipped with an additional sealing cover that is pierced simultaneously with the partition, when the GMA is forcibly inserted into the opening 3*e* of the sleeve. In this case, the GMA can be essentially a hollow tube, since protection from the atmosphere comes from the GMA cover. This embodiment provides maximum protection from external contamination.

Numerous other variations on the invention will be clear to those knowledgeable in the field, and such variations are within the scope of the invention as described and claimed, whether or not expressly described.

What is claimed is:

1. An adapter for use in a fluid delivery system, said system of the type including a protective mask having a fluid delivery tube on the interior thereof, a gas mask adapter depending from an outside region of the protective mask and coupled to the fluid delivery tube, and a canteen for the storage of a drinking fluid, said adapter comprising:

a one-piece sleeve having an opening for allowing fluid to pass therethrough, an upper sealing portion for sealing the adapter within the neck of the canteen, and a lower deformable portion; and a stopper disposed within at least a portion of the opening, movable to at least two different positions within the opening, a first position corresponding to a sealed mode of operation for preventing the drinking fluid from leaving the canteen, and a second position corresponding to an open mode of operation for allowing the drinking fluid to pass through the one-piece sleeve, wherein the lower deformable portion is normally biased to secure the stopper in the first position corresponding to a sealed mode of operation, and deformable for accommodating the stopper in the second position corresponding to an open mode of operation.

2. An adapter for use in a fluid delivery system, said system of the type including a protective mask having a fluid delivery tube on the interior thereof, a gas mask adapter depending from an outside region of the protective mask and coupled to the fluid delivery tube, and a canteen for the storage of a drinking fluid, said adapter comprising:

a one-piece sleeve having an opening for allowing fluid to pass therethrough, an upper sealing portion for sealing the adapter within the neck of the canteen, and a lower deformable portion; and a stopper disposed within at least a portion of the opening, movable to at least two different positions within the opening, a first position corresponding to a sealed mode of operation for preventing the drinking fluid from leaving the canteen, and a second position corresponding to an open mode of operation for allowing the drinking fluid to pass through the one-piece sleeve, wherein the lower definable portion is normally biased to secure the stopper in the first position corresponding to a sealed mode of operation, and deformable for accommodating the stopper in the second position corresponding to an open mode of operation, and wherein the adapter is of a size and shape for being disposed within the neck of the canteen and wherein the deformable portion extends into the canteen from the upper sealing portion.

3. An adapter as defined in claim 2, wherein the upper sealing portion includes means for accommodating a depending end of the gas mask adapter therein, for providing a fluid tight connection between the canteen and the gas mask adapter.

4. An adapter as defined in claim 3, wherein the upper sealing portion includes means for dislodging the stopper from the first position corresponding to a sealed mode of operation, and for advancing the stopper to the second position corresponding to an open mode of operation, when the depending end of the gas mask adapter is inserted therein.

5. An adapter as defined in claim 4, wherein the upper sealing portion includes means for securing the gas mask adapter therein, for maintaining the stopper in the second position corresponding to the open mode of operations.

6. An adapter as defined in claim 5, wherein the upper sealing portion includes means for causing a protruding end of the stopper to actuate a valve within the gas mask adapter when the depending end of the gas mask adapter is inserted therein, for allowing fluid to flow from the canteen to the fluid delivery tube when the canteen is tilted upwards such that gravity forces the contents of the canteen to flow.

7. An assembly as defined in claim 6, wherein the lower deformable portion normally biases the stopper to return to the first position corresponding to the sealed mode of operation when the gas mask adapter is removed from the upper sealing portion.

8. An adapter for use in a fluid delivery system, said system of the type including a protective mask having a fluid delivery tube on the interior thereof, a gas mask adapter depending from an outside region of the protective mask and coupled to the fluid delivery tube, and a canteen for the storage of a drinking fluid, said adapter comprising:

a valve system consisting of:

a one-piece sleeve having an opening for allowing fluid to pass therethrough, an upper sealing portion for sealing the adapter within the neck of the canteen, and a lower deformable portion; and a stopper disposed within at least a portion of the opening within the sleeve, and movable to at least two different positions within the sleeve, a first position corresponding to a sealed mode of operation preventing the drinking fluid from leaving the canteen, and a second position corresponding to an open mode of operation allowing the drinking fluid to pass through the one-piece sleeve, wherein the lower deformable portion is normally biased to secure the stopper in the first position corresponding to a sealed mode of operation, and deformable to accommodate the stopper in the second position corresponding to an open mode of operation.

9. An adapter for use in a fluid delivery system, said system of the type including a protective mask having a fluid delivery tube on the interior thereof, a gas mask adapter depending from an outside region of the protective mask and coupled to the fluid delivery tube, and a canteen for the storage of a drinking fluid, said adapter comprising:

a valve system consisting of:

a one-piece sleeve having an opening for allowing fluid to pass therethrough, an upper sealing portion for sealing the adapter within the neck of the canteen, and a lower deformable portion; and a stopper disposed within at least a portion of the opening within the sleeve, and movable to at least two different positions within the sleeve, a first position corresponding to a sealed mode of operation preventing the drinking fluid from leaving the canteen, and a second position corresponding to an open mode of operation allowing the drinking fluid to pass through the one-piece sleeve, wherein the lower deformable portion is normally biased to secure the stopper in the first position corresponding to a sealed mode of operation, and deformable to accommodate the stopper in the second position corresponding to an open mode of operation, and wherein the lower deformable portion comprises a substantially elliptical band for securing the stopper within the sleeve.

10. An adapter as defined in claim 9, wherein the stopper comprises a lower ball-shaped portion for being secured by the substantially elliptical band.

11. A fluid delivery system for use with a canteen which enables an individual wearing a protective mask to drink a fluid contained within the canteen without necessitating removal of the protective mask, said system including an adapter for being disposed within the neck of the canteen, and for coupling the canteen to a fluid delivery tube contained within the protective mask via a gas mask adapter depending from the outside of the protective mask, said adapter comprising:

a stopper for preventing the flow of the fluid from inside the canteen to outside the canteen in a first mode of operation, and for allowing the fluid to pass from inside the canteen to outside the canteen in a second mode of operation; and a sleeve for disposing the stopper therein, said sleeve including sealing means for sealing within the neck of the canteen, an opening for communicating between the interior of the canteen and the exterior of the canteen, and deformable biasing means for normally biasing the stopper in a first position corresponding to the first mode of operation, and for deforming to accommodate the stopper in a second position corresponding to the second mode of operation when an external force is applied thereto, said deformable biasing means including a resilient band for embracing a ball-shaped lower end of the stopper, for contacting fluid contained in the canteen.

12. A fluid delivery system as defined in claim 11, wherein the stopper is movable to the second position corresponding to the second mode of operation by inserting the gas mask adapter into the opening within the sleeve and dislodging the stopper from the first position.

13. A fluid delivery system as defined in claim 12, wherein the stopper is movable to the first position from the second position by removing the gas mask adapter from the opening within the sleeve.

14. A fluid delivery system as defined in claim 13, wherein the means for sealing the assembly within the neck of the canteen includes a holder, having threads for screwing into the neck of the canteen, and a cavity for accommodating the upper sealing portion of the sleeve.

15. A fluid delivery system as defined in claim 14, further including a removable cover for covering and sealing the opening.

16. A fluid delivery system for dispensing fluids from a canteen to a gas mask having a gas mask adapter, comprising:

an adapter of a size and shape for frictionally engaging an inner surface of an upper neck region of the canteen to provide a hermetic seal therewith, the adapter having a single movable member for being disposed within a portion of an opening thereof, the single movable member movable to a first position blocking the opening of the adapter and to a second position unblocking the opening of the adapter, the single movable member in use actuated by the gas mask adapter, and the gas mask adapter in use actuated by the single moveable member.

17. A fluid delivery system as defined in claim 16, wherein the adapter is constructed from a non-metallic material.

18. A fluid delivery system as defined in claim 17, wherein a portion of the adapter is formed of silicone.

* * * * *

UNITED STATES PATENT AND TRADEMARK OFFICE

CERTIFICATE OF CORRECTION

PATENT NO. : 6,325,116 B1
DATED : December 4, 2001
INVENTOR(S) : Savage et al.

It is certified that error appears in the above-identified patent and that said Letters Patent is hereby corrected as shown below:

Column 3,
Line 18, "6f" should read -- of --.

Column 10, claim 2,
Line 22, the word "definable" should read -- deformable --.

Column 10, claim 5,
Line 46, the word "operations" should read -- operation --.

Signed and Sealed this

Ninth Day of April, 2002

*Attest:*

*Attesting Officer*

JAMES E. ROGAN
*Director of the United States Patent and Trademark Office*